US005646488A

United States Patent [19]

Warburton

[11] Patent Number: 5,646,488

[45] Date of Patent: Jul. 8, 1997

[54] DIFFERENTIAL PUMPING STAGE WITH LINE OF SIGHT PUMPING MECHANISM

[76] Inventor: William K. Warburton, 1300 Mills St., Menlo Park, Calif. 94025

[21] Appl. No.: 540,806

[22] Filed: Oct. 11, 1995

[51] Int. Cl.[6] ..... H01J 7/24

[52] U.S. Cl. ..... 315/111.81; 315/111.91; 315/111.21; 315/111.41

[58] Field of Search ..... 315/111.81, 111.91, 315/111.21, 111.41, 111.01, 108, 5.42, 5.35, 5.24, 5.26, 5

[56] References Cited

U.S. PATENT DOCUMENTS

| | | | |
|---|---|---|---|
| 3,391,303 | 7/1968 | Hall | 315/108 |
| 4,417,178 | 11/1983 | Geller et al | 315/111.81 |
| 4,691,109 | 9/1987 | Magee et al. | 315/111.81 |
| 4,926,093 | 5/1990 | Sugawara | 315/4 |
| 4,978,889 | 12/1990 | Schumacher | 315/111.12 |

*Primary Examiner*—Robert Pascal
*Assistant Examiner*—Haissa Philogene
*Attorney, Agent, or Firm*—Townsend and Townsend and Crew

[57] ABSTRACT

An apparatus allows photons in the infrared, visible, ultraviolet, soft x-ray and hard x-ray energy ranges to pass freely along a line of sight path between two vacuum regions at different pressures, yet maintains the pressure difference between the two regions and, in particular, removes vapor species attempting to pass between the two regions along the line of sight path. The apparatus works by causing the line of sight path to pass through a volume provided with a pumping mechanism which is transparent to the photons. Within this volume the vapor species are ionized and deviated from the line of sight by both magnetic and electric fields. The ionization mechanism is provided by an electron plasma created by the Penning discharge mechanism in an equipotential volume between two sets of electrodes. Vapor species attempting to pass through the electron plasma are ionized by collisions with the electrons in the plasma and removed from the line of sight path by the magnetic and electric fields used to maintain the Penning discharge.

13 Claims, 4 Drawing Sheets

FIG. 2A
(PRIOR ART)
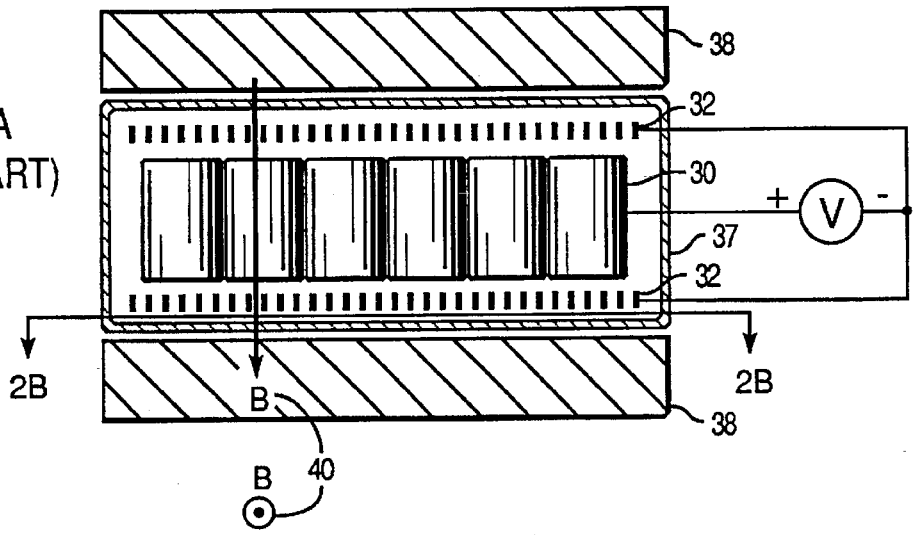
FIG. 2B
(PRIOR ART)
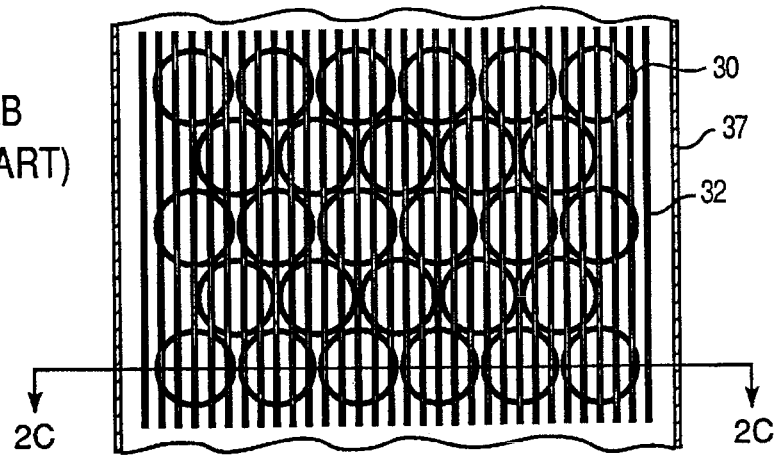
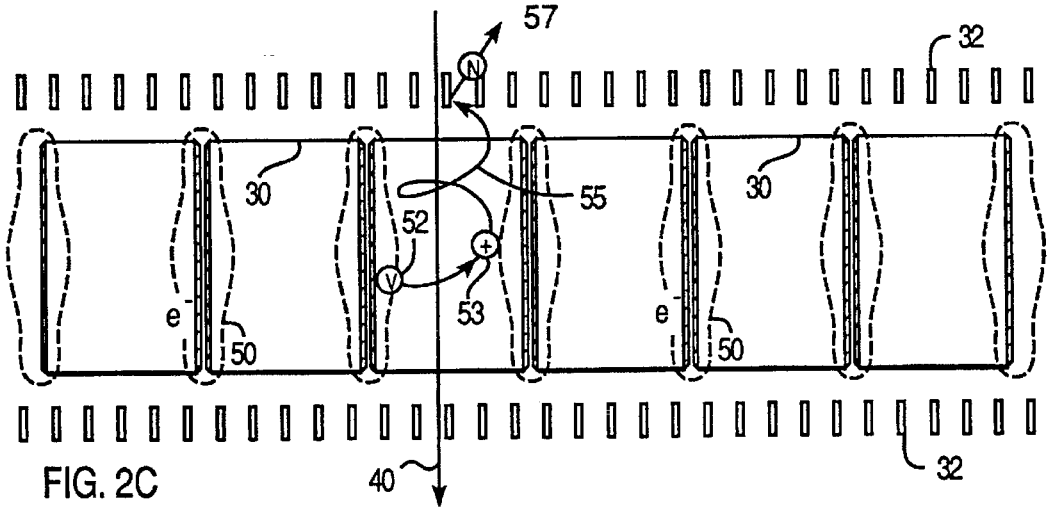
FIG. 2C
(PRIOR ART)

DIFFERENTIAL PUMPING STAGE WITH LINE OF SIGHT PUMPING MECHANISM

BACKGROUND OF THE INVENTION

Storage rings are commonly used to create synchrotron radiation for use in experiments in a variety of fields including chemistry and physics. This radiation is photonic in nature and spans the energy range from deep infrared to the hard x-ray. In order for the storage ring to function properly, it must be operated in the ultrahigh vacuum (UHV) pressure regime below $10^{-9}$ Torr. Many experiments, on gases or high vapor pressure materials, for example, are incompatible with UHV conditions, however, and must therefore be isolated from the storage ring and its ancillary beamlines. Thin windows are often used for this purpose, but photons in some portions of the synchrotron spectrum cannot effectively penetrate even the thinnest windows that are technologically possible.

In these cases, differential pumps have been used to provide the necessary isolation. FIG. 1A shows a schematic diagram to illustrate the principle of differential pumping. The pump diagrammed in FIG. 1A is a two-stage pump. The first stage consists of a first vacuum vessel 10 connected by a tube 12 of constricted dimensions to a second vacuum vessel 13 to which a pump 15 is attached. The second stage, which is a repetition of the first stage, is formed by a second constricted tube 17 connecting second vacuum vessel 13 to a third vacuum vessel 18, which also has an attached vacuum pump 20. As shown in the drawing, the pressures in the vacuum vessels are $P_1$, $P_2$, and $P_3$, respectively. The pumping speeds of the two pumps are $F_1$ and $F_2$, and the conductances of the two tubes $C_1$ and $C_2$. In the situation as drawn, under the simplifying assumptions that the first vacuum vessel is the only source of gas present, that the pumping speeds of the pumps are much greater than the conductances of the constricted tubes, and that the system is operating in the molecular flow regime, then it is easy to show from standard vacuum formulae that the pressure in the third vacuum vessel is:

$$P_3=(C_1/F_1)(C_2/F_2)P_1 \quad (1)$$

EQN. 1 shows that, by using tubes with small conductances and pumps with large pumping speeds, very large pressure ratios may be obtained between the first and third vacuum vessels. For example, conductances of less than 1 liter/sec are readily obtained, as are pumping speeds in excess of 100 liter/sec. This would produce a pressure ratio of over $10^4$, allowing a vessel at $10^{-5}$ Torr to be connected to a vessel of $10^{-9}$ Torr.

FIG. 1B shows a cross-sectional view of an apparatus for implementing FIG. 1A, constructed using conventional UHV flanged stainless steel vacuum components. In this implementation the constricted tubes 12 and 17 of FIG. 1A are constructed of rectangular copper waveguide tubes 24 brazed into OFHC copper disks 25, which, in turn, are bolted to the flanged faces of two vacuum nipples 26. These assemblages are connected by vacuum tees 27 to schematically drawn ion pumps 28 as shown.

In the molecular flow regime vapor species (atoms or molecules) essentially never collide with one another. They travel in straight lines until they collide with some object, such as the vacuum vessel wall. After each collision they are reflected diffusely, departing from the point of impact in an essentially random direction relative to their direction of travel prior to the collision. The path followed by any particular vapor specie is thus a random walk, typically taking many steps to diffuse from one part of a vacuum system to another. FIG. 1B shows an example 29 of the complex path a molecule exiting a tube 24 might have to follow to reach a pump 28 and be removed from the system. This is why constricting tubes, such as 24, are effective in preventing molecular flow from one region to another: many reflections are required and in each reflection the molecule is as likely to make backward as forward progress. It also explains why, in each differential pumping stage, the closer the pump 28 is to constricting tube 24 the more effective the stage is, since the vapor species exiting the tube are more likely to reflect randomly into the pump before they reach the entrance to the constricting tube of the next differential section.

In the rest of this discussion only two-stage differential pumps will be discussed, since they are most commonly used in synchrotron applications. It should be clearly understood, however, that the same principles apply whether a single stage or multiple pumping stages are employed.

The principle of differential pumping has been applied to the synchrotron radiation problem by making the tubes in the successive pumping stages collinear so that light may pass through them on the path indicated by the line 22 shown in FIG. 1A. Third vacuum vessel 8 may then be connected to the storage ring or its beamline, while first vessel 10 can be connected to the experimental chamber. This allows the synchrotron light to pass from the third vacuum vessel to the first vacuum vessel along line 22 without passing through any physical barriers, yet also allows the required pressure difference to be maintained between the first and third vacuum vessels. It is not critical what type of pumps are used to supply the pumping action. Ion pumps, cryopumps, and turbo-molecular pumps have all been employed to implement pumps 15 and 20.

The prior art described above has one significant problem. This is that, while the synchrotron light passes from vacuum vessel 18 to vacuum vessel 10 along line 22, any vapor species (atoms or molecules) in vacuum vessel 10 which are traveling along line 22 in the opposite direction will pass unimpeded into vacuum vessel 18, since there is no physical barrier to their motion. While this beam is generally an insignificant fraction of the vapor species in first vacuum vessel 10, it may be a significant fraction in third vacuum vessel 18 because the pressure in third vacuum vessel 18 is so much lower. Furthermore, since this beam of vapor species is headed directly opposite to the synchrotron light, it will also impinge on any optics used to direct or focus the synchrotron light, where its constituent atoms or molecules may deposit or cause reactive damage. It would therefore be advantageous to have a differential pump which not only connected two vacuum regions along a line of sight, so that photons could freely pass between them, but also prevented vapor species from doing the same. The present invention addresses this problem by creating a mechanism which is capable of pumping any vapor species attempting to travel along the line 22, yet which is also completely transparent to the passage of photons of energies greater than the infrared.

In order to comprehend the operation of the invention pump it is necessary to understand the operation of prior art triode ion pumps which operate based on the Penning discharge mechanism. Two sectional views of the structure of such a triode ion pump are shown in FIGS. 2A and 2B. The pump comprises an electrode structure consisting of an anode 30 and a pair of cathodes 32 supported within a vacuum housing 37 which lies between a pair of magnets 38. The magnets fill the electrode volume with a magnetic field (B) 40 as indicated. The anode 30 comprises a 2-dimensional raft of short metal tubes which are usually spot welded together to form a rigid array. The tubes are typically about 2 cm in diameter by 3 cm long and made of stainless steel. The cathodes 32 are grids composed of long strips of a reactive metal such as Titanium or Tantalum, the strips each being typically about 0.5 mm by 4 mm in cross section. The figures do not show the structures which support the electrodes and isolate them electrically from each other and the vacuum housing, since these details are well known to those skilled in the art.

A simplified description of the operation the Penning mechanism is as follows, and may be understood by reference to FIG. 2C, which is a schematic diagram of a cross section through the electrode structure in a direction parallel to the cathode strips, as indicated in FIG. 2B. The cathode grids 32 are negatively biased compared to both the anode 30 and the vacuum housing 37, which are both usually at ground potential. Any electron finding itself anywhere between the two cathodes 32 is therefore attracted toward the wall of the nearest tube in the anode. As it attempts to move toward the tube wall, however, its velocity perpendicular to the magnetic field B produces an electromagnetic force at right angles to both its velocity and the field B, according to the well known "right hand rule." The result is that electrons are unable to reach the tube walls and instead form an electron plasma sheath surrounding them. Within this sheath each electron follows a looping orbit which, in the direction perpendicular to B, precesses about the inside of a single tube. In the direction parallel to B, where no tangential force is generated, the electrons are free to travel until they begin to leave the anode tubes 30 and approach the cathode grids 32. At this point they are repelled by the negatively biased cathode and forced back toward the anode. The electrons cannot escape from the "trap" thus formed and instead can only oscillate up and down between the grids and close to the tube walls. The resultant electron plasma sheathing the anode tubes is therefore stable and persistent. The nominal shape and location of the electron plasma 50 with respect to the anode tube walls is shown by dashed lines in FIG. 2C.

The electron orbits within the plasma sheath 50 are quite long lived and are terminated primarily by collisions with vapor species. These collisions are, in fact, the "ion pumping" mechanism, since each collision typically ionizes the vapor specie involved, which has two consequences. First, another electron is generated to join the pool of electrons in the electron plasma sheath 50 which are available to ionize further vapor species. Secondly, as indicated in FIG. 2C, where an atom V 52 is struck by an electron in the electron plasma, the ionized specie 53 feels an electric field from and is attracted toward the nearest (negatively biased) cathode grid 32. Its motion in this direction is essentially parallel to the magnetic field B 40 and is thus unimpeded. Any velocity perpendicular to B 40 generates an electromagnetic force, just as in the case of the electrons described above. As a result, the ion follows a helical orbit 55 from its point of generation until it collides with the cathode grid 32. As noted above, the grid is typically made of a chemically active material, such as Titanium or Tantalum. When the ion strikes the grid, it sputters neutral atoms N 57 of this material onto the surrounding pump walls, where other gas molecules can chemisorb to it, creating a secondary pumping mechanism. The ion itself is either be buried within the grid material by the force of its impact or, neutralized, can be chemisorbed there. In either case it has been removed from the vapor, which was the desired intent.

At a deeper level, Penning discharges are much more complex and the details of the electron plasma sheaths 50 surrounding the anode tubes 30 are not fully understood, in spite of numerous studies. It is known that the plasma tends to form a relatively dense layer, close to the anode tube walls and to shield their potential fairly effectively. The cathode grid 52 potential can thus penetrate into the anode tubes for significant distances along their axes, the exact distances depending in detail upon the applied voltage, magnetic field strength, and anode tube dimensions. As a result of this penetration, the electric field inside the tubes also has a strong radial component across the plasma sheath. To the extent that the cathode potential does not fully penetrate the anode tubes, the electron plasma is less dense and does not lie as close to the tube walls. The plasma sheaths 50 in FIG. 2C show this effect, thickening somewhat in the middle of the anode tubes 30.

In prior art, the inventor introduced a modification of the standard triode electrode geometry in order to create differential pumps with increased efficiency. In this design a triode ion pump was employed as first stage pump 15 in FIG. 1, and, as shown in FIG. 3, the standard triode electrode structure of FIG. 2A was employed with a single exception. The difference was that one or more rows of shortened tubes 60 were included in the raft of anode tubes 30. Shortening these tubes created a path whereby synchrotron light could pass through the length of the ion pump unimpeded. This allowed the pump $F_1$ to be moved up until the line of sight 22 literally passed through it. Vapor species diffusing from first vacuum vessel 10 toward third region vacuum vessel 18 through constricted tube 12 are now injected directly into the active pumping region of the ion pump, greatly improving the efficiency with which they are pumped, since far fewer reflective bounces are required to reach the pump's active pumping region. Effective pumping speeds were increased by factors of approximately 10 by this stratagem, with a 110 liter/sec sized pump producing pressure drops which would have required a 1000 liter/sec pump in the traditional arrangement shown in FIG. 1. This improvement, however, does not address the line of sight problem described above, since it does not introduce any pumping mechanism for vapor species traveling in the region between the cathode grid 32 and the top of the shortened anode tubes 60. In particular, because the electron plasma sheaths lie close to the anode tube walls, they do not enter into this region and interact with the vapor species in it.

SUMMARY OF THE INVENTION

The present invention provides a technique for connecting two vacuum vessels along a line of sight, so that photons of infrared or higher energy can pass freely between them, while providing a pumping mechanism which obstructs vapor species from doing the same. The pumping mechanism of the invention also provides the general pumping action needed to make an effective differential pumping stage.

In brief, the present invention contemplates using a Penning discharge to create an electron plasma within a volume through which the line of sight passes. Vapor species attempting to traverse this volume are ionized by collisions with the electrons. Once ionized, they are readily deviated from their motion along the line of sight by either a magnetic field or an electric field, which can be the same magnetic and/or electric fields required to maintain the Penning discharge. Since the cross section for photon-electron interaction is small for photon energies in the infrared and above, the photons can traverse this region unimpeded.

More specifically, a particular embodiment consists of an ion pump which operates based on the principle of the Penning discharge. This pump is arranged within one vacuum vessel which is connected to adjacent vacuum vessels on either side by a pair of collinear tubes of restricted dimensions. The pump is oriented so that the line of sight between the collinear tubes passes through the pump's electrode structure in a direction perpendicular to the magnetic field required to maintain its Penning discharge. A portion of the electrode structure is removed so that the line of sight through the collinear tubes is not obstructed by the electrode structure and this is done in a manner which creates a volume at the same electric potential as the anode electrodes which generate an electron plasma via the Penning discharge mechanism. This volume then fills with electrons from the plasma and these collide with, and ionize, any vapor species attempting to traverse the line of sight path.

The pressure difference between two vacuum regions connected by this apparatus can thus be maintained with the additional advantages that photons can pass freely between them because there is no physical barrier and yet vapor species are restricted from passing along the same line of sight path.

A further understanding of the nature and advantages of the present invention may be realized by reference to the remaining portions of the specification and the drawings.

Figure 1A:
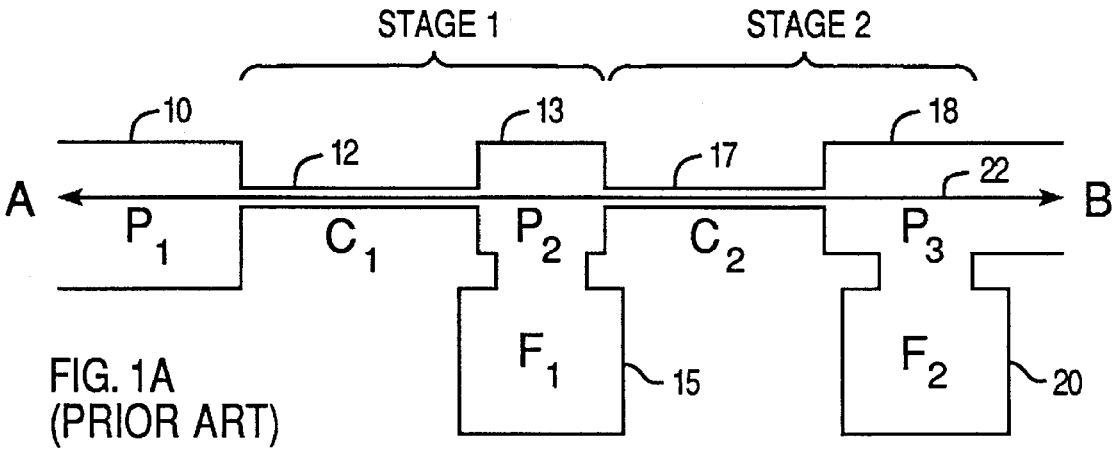
FIG. 1A (PRIOR ART)
FIG. 1A is a schematic diagram of a conventional differential pumping system.
Figure 3:
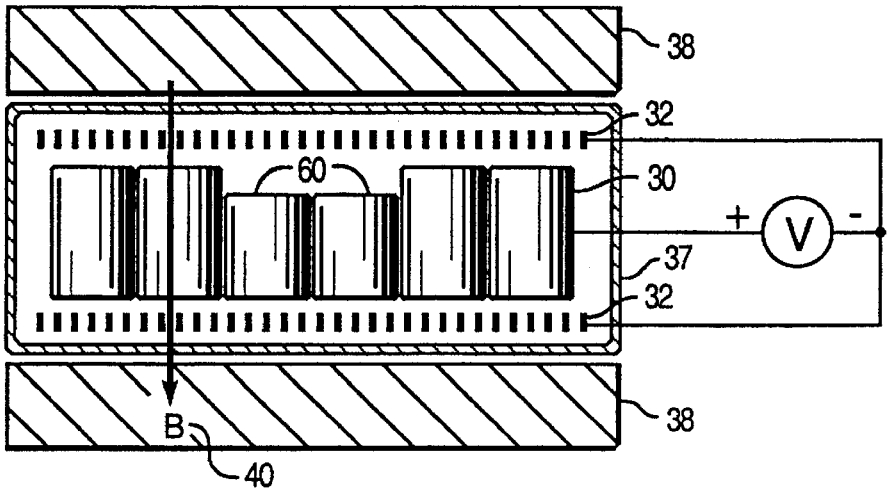
FIG. 3 (PRIOR ART)
Figure 4:
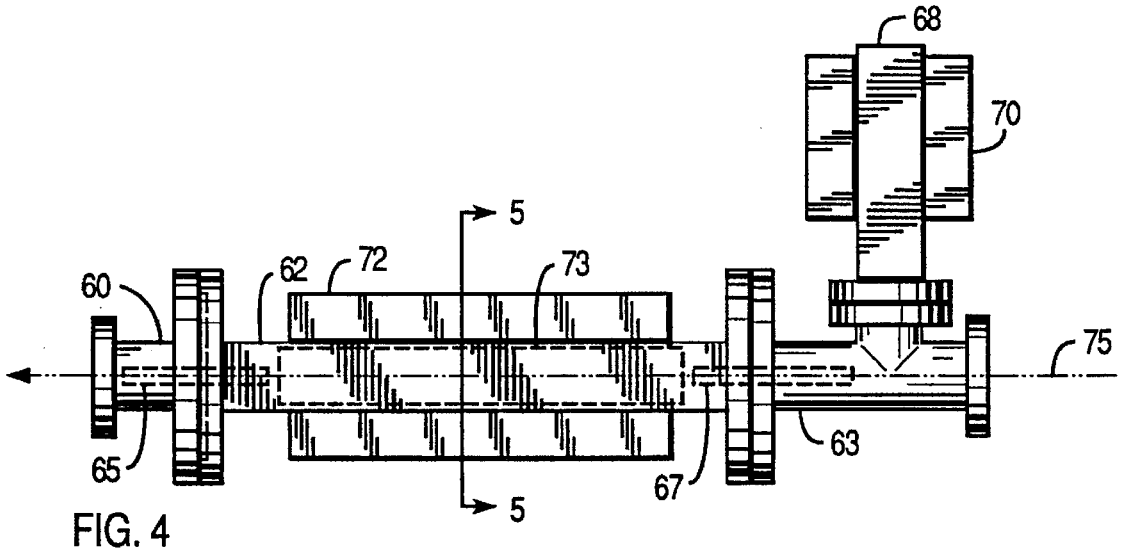
Figure 5:
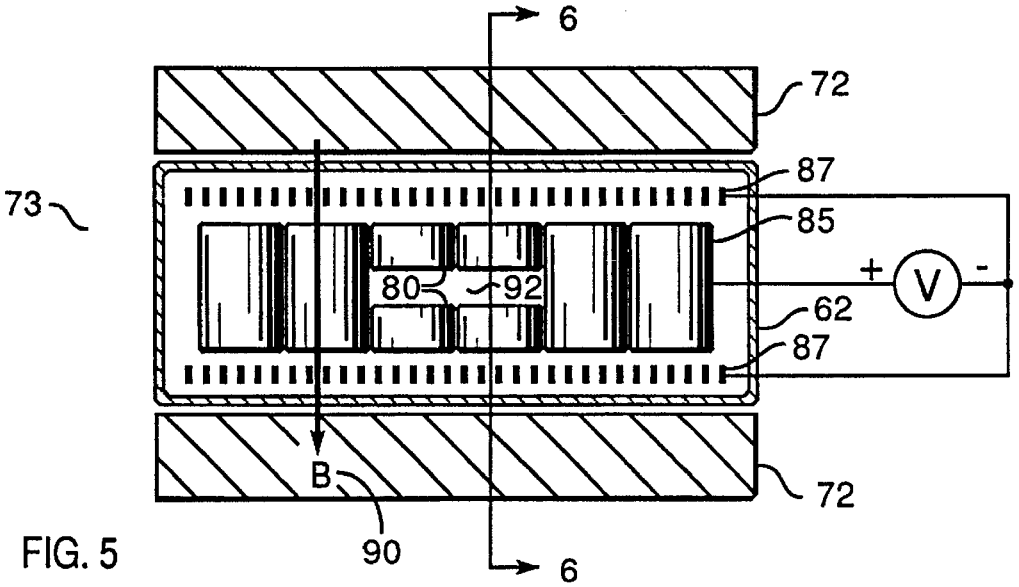
Figure 6:
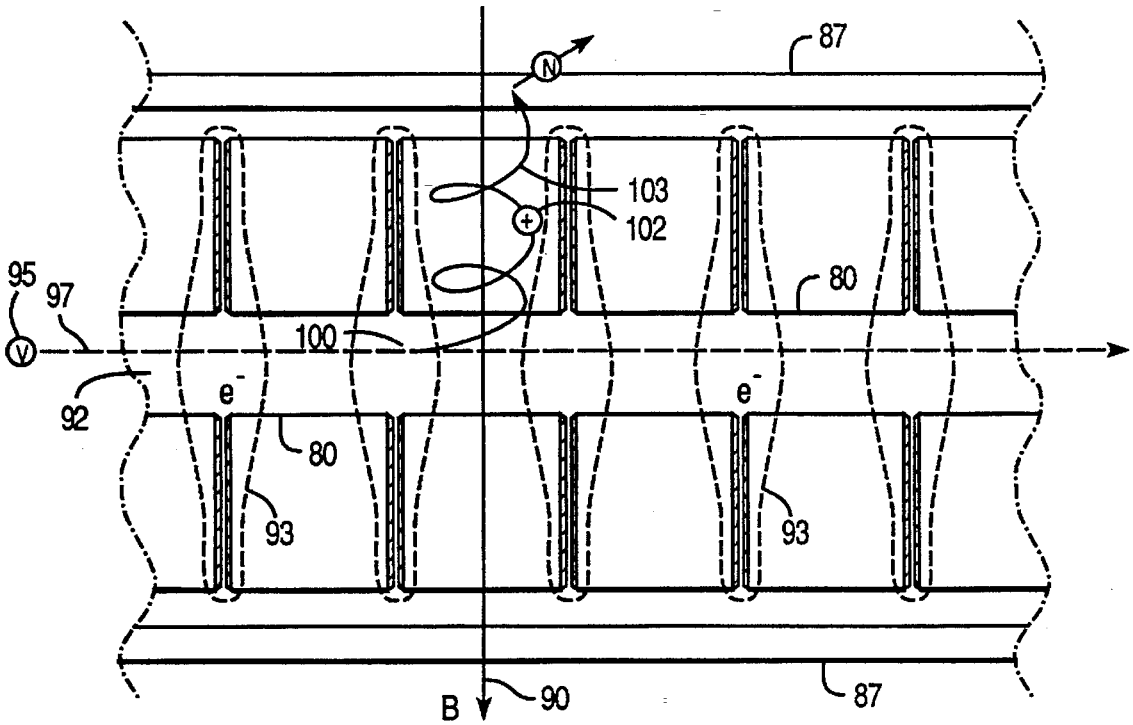

FIB. 1B shows n implementation of FIG. 1A using conventional vacuum hardware;

FIGS. 2A–B are cross and top sectional views illustrating the structure of a conventional triode ion pump which operates using the Penning discharge mechanism;

FIG. 2C is a schematic cross section through the triode electrode structure illustrating the mechanism of ion pumping via the Penning discharge;

FIG. 3 illustrates a prior art modification of the triode electrode structure to increase differential pumping efficiency;

FIG. 4 illustrates an embodiment of the invention differential pump;

FIG. 5 illustrates a triode electrode structure which produces an electron plasma filled transit volume; and FIG. 6 is a schematic cross sectional drawing of the invention triode electrode structure, illustrating its operation.

DESCRIPTION OF THE SPECIFIC EMBODIMENT

FIG. 4 shows an embodiment of the invention two-stage differential pump. It consists of three stainless steel vacuum vessels 60, 62, and 63, which are connected together by ultrahigh vacuum (UHV) flanges. Between the first vessel 60, which is essentially a vacuum nipple, and the second vessel 62 is a constricted tube 65 fabricated in a similar manner to the tubes 24 in FIG. 1B. A similar tube 67 connects the second vessel 62 to the third vessel 63, which is essentially a vacuum tee. Attached to the tee is a vacuum pump 68. In this specific embodiment it is an ion pump with an external magnet 72. This pump corresponds to the pump $F_2$ in FIG. 1 and needs to be present to complete the second stage of differential pumping. The mechanism by which it operates is not an important factor in the operation of the invention, however, and in other embodiments other types of pumps may be used.

The significant feature of the implementation shown in FIG. 4 is that second vacuum vessel 62 contains a pumping mechanism which specifically acts on any vapor species (i.e., atoms or molecules) traveling along the "line of sight," that is collinear with the two constricted tubes 65 and 67. In addition, a generalized pumping action is also provided, as is required by the differential pumping concept presented in FIG. 1 and EQN 1. In the specific embodiment these pump processes are based on the Penning discharge and so require a magnetic field, which is supplied by exterior magnet 72, and a triode electrode structure 73 inside the second vacuum vessel 62. The arrow 75 indicates the line of sight through the device.

The modifications to the triode structure employed in the specific embodiment may be readily comprehended by comparing a cross sectional view of the conventional triode ion pump shown in FIG. 2A to the same view of the invention triode electrode structure 73 shown in FIG. 5. In particular, the anode tubes in one or more rows in the anode tube raft 30 have been replaced by pairs of short tubes 80 with a space 92 between. The remaining anode tubes 85, the cathode grids 87, magnet 72, magnetic field 90, and other details of the electrode and pump construction are essentially unchanged from the conventional structure, beyond providing holes in the electrode support structures to create a clear line of sight through the resultant intertube clearance space 92. As can be seen from the placement of the invention electrode structure 73 in the invention differential pump shown in FIG. 4, the constricting tubes 65 and 67 are placed and aligned so that the line of sight 75 between them passes through the intertube clearance space 92 in the triode electrode structure 73.

Figure 1B:
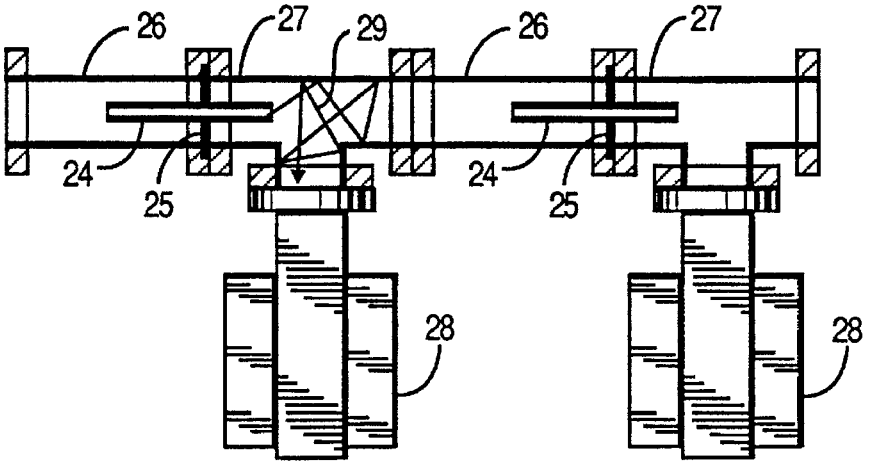
FIG. 1B (PRIOR ART)

The generalized pumping mechanism, corresponding to pumping speed $F_1$ in FIG. 1, is provided in the specific embodiment by ion pumping based upon the Penning mechanism, just as in both the conventional ion pumps represented by FIG. 1B and the improved differential pump represented by FIG. 3. Because vapor species diffusing through constriction 65 are still directly injected into the active pumping region of the invention triode electrode, it will continue to deliver the enhanced pumping capability found in the prior art design illustrated in FIG. 3.

The mechanism of operation of the invention pumping action for line of sight vapor species may be understood by reference to FIG. 6, which shows the invention electrode in a sectional view of the plane including the axes of one row of separated tube pairs, as indicated in FIG. 5. The electron plasma sheaths 93 surrounding the anode tube pairs 80 are also shown. On the ends of the anode tubes closest to the cathode grids 87, the plasma sheaths only extend part way to the grids, since they are created by the potential difference between the tubes and the grids as described above The cutout region 92 between the tubes 80, however, acts like an equipotential region since it is bounded on all sides by the tubes which are all at the same voltage. Electrons which are within a plasma sheath close to one of the upper tube walls and which are spiraling downward along the direction of the magnetic field (B) 90, therefore do not feel any restoring force when they reach the tube end and can continue freely out into the cutout region 92. They can, in fact, cross this region and enter into a plasma region associated with a lower tube and so continue downward until they are eventually repelled by the potential on the lower grid 87 just as they would have had a full length tube been present. Electrons headed upwards from the lower tubes' plasma sheath similarly can cross the cutout region and join the sheaths on the upper anode tubes. The result then, is that the plasma sheaths do not actually terminate close to the tube ends facing the cutout region but instead continue across it, as schematically represented by the plasma sheath outlines 93. The precise shape of the plasma sheath in this region (e.g., whether it bulges out as shown in 93) depends upon the applied potential, magnetic field strength, and tube dimensions and can be adjusted by adjusting these parameters.

The result of this construction, therefore, is that the equipotential cutout region is filled with a high density of electrons in the form of plasma sheaths 93 extending from the ends of all the short tubes which form the cutout region. Any vapor species V 95 attempting to traverse this region along the line of sight path 97 (corresponding to the line of sight 22 in FIG. 1), therefore has a very high probability of being struck by one of these electrons, as shown at location 100, and converted to an ion 2. Once ionized, it is subjected to both electric and magnetic forces which cause its trajectory to depart from the line of sight 97. These forces arise from the electric and magnetic fields required to maintain the Penning discharge. The magnetic field B 90 generates a force perpendicular to the line of sight 97 and itself, according to the "right hand rule." The electric field is more complex, having both radial and axial components within the individual tubes in raft 85, but its axial component, at least, will exert a force parallel to B and perpendicular to the line of sight path 97. The ionized specie will therefore be attracted to the cathode grid 87 along the helical path 103, and pumped, in the same manner as was illustrated by FIG. 2C for vapor species in the standard ion pump.

Photons at infrared and higher energies, on the other hand, have very small cross sections for interaction with electrons and so can traverse the plasma filled intertube region unimpeded. Thus a mechanism has been invented which is capable of pumping line of sight vapor species while allowing free passage for light and x-rays of any energy.

The specific embodiment described above, comprising one modified differential pumping stage and a second, conventional differential pumping stage, was tested for a case where the constricted tubes 35 and 37 had dimensions 8 mm×8 mm ×15 cm in length and the separation between the cutout tubes was 10 mm. The construction of the anode and cathode grid assemblies was otherwise similar to that commonly found in 110 liter/sec ion pumps, as was the magnet 72. The electrode potential was supplied by a conventional triode ion pump power supply. A 60 liter/sec secondary pump $F_2$ 68 was used. A Nitrogen supply was attached to nipple 60 by a valve which allowed the $N_2$ pressure at the nipple to be adjusted upwards from $10^{-9}$ Torr. A residual gas analyzer (RGA) operating in the $10^{-10}$ Torr range after baking was attached to the tee 63 by a slide with a 3 mm aperture in it. The slide mechanism otherwise sealed the passage between the tee and the RGA. The slide had sufficient range of motion so that it could be moved either to allow any line of sight $N_2$ molecules to enter the RGA chamber or to exclude such molecules. After baking, the sensitivity of the RGA to $N_2$ was in the $10^{-12}$ Torr range. It was found that no direct $N_2$ beam could be detected by the RGA even for inlet pressures up to $1\times10^{-5}$ Torr. The experiment was tried again using Argon gas, which is relatively difficult for ion pumps to pump, since it does not chemisorb well, with essentially the same result.

The invention mechanism therefore appears to be extremely efficient at pumping line of sight vapor species. Furthermore, the modifications introduced to pump line of sight vapor species did not appear to significantly reduce the pump's pumping speed for non-line of sight species compared to the enhanced pumping behavior found for the design shown in FIG. 3. The invention therefore preserves the performance benefits of the previous design while removing the line of sight beam in addition.

Conclusion

While the above is a complete description of specific embodiments of the invention, various modifications, alternative constructions, and equivalents may be used. For example, while the specific embodiment uses a conventional pump 68 in the second differential pumping stage, it is also possible to use a line of sight pump according to the invention in the second stage in order to further reduce the probability of a vapor specie transiting the entire pump. Moreover, while in the specific embodiment the vapor species are ionized by impacts with electrons in a plasma generated by a Penning discharge, the electron plasma could be generated by other techniques. Indeed, the ionization step could even be accomplished by other means than electron impact, including ionization through the application of radio frequency or microwave fields. Therefore, the above description should not be taken as limiting the scope of the invention as defined by the appended claims.

What is claimed is:

1. A method which provides a line of sight path for photons to pass freely between two vacuum regions while pumping vapor species which attempt to travel between the two regions along the line of sight path, the method comprising the steps of:

ionizing the vapor species attempting to move along the line of sight path; and removing the vapor species, so ionized, from the line of sight path by the use of electric and/or magnetic fields.

2. The method of claim 1 wherein:

the vacuum regions are at different pressures; and said ionizing step is performed in an intermediate region between the vacuum regions and is performed on vapor species traveling through the intermediate region, including vapor species traveling along the line of sight path.

3. The method of claim 1 wherein said ionizing step includes:

providing an anode structure having an open portion surrounding the line of sight path in an intermediate region between the two vacuum regions;

providing a cathode structure having opposed portions separated by said anode structure; and applying an electrical voltage between the anode and cathode structures so as to generate an electron plasma in the intermediate region.

4. The method of claim 1 wherein said ionizing step further includes:

generating a magnetic field generally perpendicular to the line of sight path.

5. A method for maintaining an unimpeded line of sight path between a first vacuum region at a first pressure and a second vacuum region at a second pressure that is significantly lower than the first pressure, the method comprising the steps of:

generating an electron plasma in an intermediate region disposed in the line of sight path so as to ionize vapor particles travelling through the intermediate region, including particles travelling along the line of sight path;

deflecting the ionized particles out of the line of sight path; and pumping the second vacuum region.

6. The method of claim 5 wherein said deflecting step includes providing a magnetic field having a component perpendicular to the line of sight path.

7. The method of claim 5 wherein said generating step includes the step of maintaining a Penning discharge in the intermediate region.

8. The method of claim 5 where the electron plasma is extended from a region wherein it is created into the line of sight path by causing the intermediate region surrounding the line of sight path to be at the same electrostatic potential as the region wherein the plasma is created.

9. Apparatus for maintaining an unimpeded line of sight path between a first vacuum region at a first pressure and a second vacuum region at a second pressure that is significantly lower than the first pressure, the apparatus comprising:

an anode structure having an open portion surrounding the line of sight path in an intermediate region between the first and second vacuum regions;

a cathode structure having opposed portions separated by said anode structure;

an electrical voltage generator coupled between the anode and cathode structures, the voltage generator having a sufficiently high voltage output to generate an electron plasma in the intermediate region; and a magnet having opposed pole elements disposed outside said cathode structure so as to generate a magnetic field generally perpendicular to the line of sight path.

10. The apparatus of claim 9 wherein:

the anode structure comprises a plurality of parallel metal tubes extending perpendicular to the line of sight path with at least some tubes being shorter than other tubes; and the open portion of the anode structure is defined by spaces between spaced pairs of the shorter tubes.

11. The apparatus of claim 9 wherein:

the cathode structure comprises first and second pluralities of metal strips extending in respective first and second planes on opposite sides of the anode structure.

12. A method which provides a line of sight path for photons to pass freely between two vacuum regions while pumping vapor species which attempt to travel between the two regions along the line of sight path, the method comprising the steps of:

using a Penning discharge to create an electron plasma within a volume through which the line of sight path passes so as to ionize vapor species passing through the volume, including the vapor species attempting to move along the line of sight path; and removing the vapor species, so ionized, from the line of sight path by the use of electric and/or magnetic fields.

13. The method of claim 12 wherein:

the Penning discharge is maintained with electric and magnetic fields; and the electric and/or magnetic fields used to remove the vapor species, so ionized, are the same electric and magnetic fields used to maintain the Penning discharge.

* * * * *